United States Patent [19]

Miyamoto et al.

[11] 4,172,727

[45] Oct. 30, 1979

[54] DESENSITIZER COMPOSITIONS

[75] Inventors: Akio Miyamoto; Hajime Kato, both of Minami-ashigara, Japan

[73] Assignee: Fuji Photo Film Co., Ltd., Minami-ashigara, Japan

[21] Appl. No.: 823,476

[22] Filed: Aug. 10, 1977

Related U.S. Application Data

[63] Continuation of Ser. No. 658,938, Feb. 17, 1976, abandoned.

[30] Foreign Application Priority Data

Feb. 17, 1975 [JP] Japan ..... 50/19555

[51] Int. Cl.[2] ..... G03C 1/36; G03C 5/32

[52] U.S. Cl. ..... 96/62; 427/150; 427/151; 427/261; 428/411; 428/913

[58] Field of Search ..... 428/411, 913; 427/150, 427/151, 261; 96/62

[56] References Cited

U.S. PATENT DOCUMENTS

| | | | |
|---|---|---|---|
| 2,777,780 | 1/1957 | Cormack et al. | 427/261 |
| 3,579,333 | 5/1971 | Land et al. | 96/62 X |
| 3,856,553 | 12/1974 | Hayashi et al. | 427/150 X |
| 3,931,430 | 1/1976 | Tada et al. | 427/151 |
| 3,952,117 | 4/1976 | Miyamoto | 427/261 |
| 3,955,026 | 5/1976 | Matsukawa | 427/150 X |
| 4,007,310 | 2/1977 | Miyamoto et al. | 427/150 X |
| 4,012,538 | 3/1977 | Miyamoto et al. | 427/150 X |
| 4,022,624 | 5/1977 | Miyamoto et al. | 96/62 X |
| 4,039,207 | 8/1977 | Ishizuka | 427/151 X |
| 4,073,968 | 2/1978 | Miyamoto et al. | 427/151 X |

*Primary Examiner*—Harold Ansher

*Attorney, Agent, or Firm*—Sughrue, Rothwell, Mion, Zinn and Macpeak

[57] ABSTRACT

Desensitizer compositions which reduce or extinguish the capability of developers to color colorless compounds which comprise one or more desensitizers and one or more compounds having an absorption peak in the wavelength region of from about 300 mμ to about 400 mμ and a molecular absorption coefficient of above about 2000.

30 Claims, No Drawings

DESENSITIZER COMPOSITIONS

CROSS-REFERENCE TO RELATED APPLICATIONS

This application is a continuation of patent application Ser. No. 658,938, filed Feb. 17, 1976, now abandoned.

BACKGROUND OF THE INVENTION

1. Field of the Invention

The present invention relates to desensitizer compositions. In greater detail, it relates to desensitizer compositions which reduce or extinguish the function of developers of coloring colorless couplers.

2. Description of the Prior Art

It is known that a developed color image can be formed by the contact reaction between an electron donating or proton accepting colorless organic compound (hereinafter, called a coupler) and an electron accepting or proton donating solid acid (hereinafter called a developer). This phenomenon has been utilized in pressure-sensitive copying papers (for example, as described in U.S. Pat. Nos. 2,505,470, 2,505,489, 2,550,471, 2,548,366, 2,712,507, 2,730,456, 2,730,457, 3,418,250 and 3,672,935) and in heat-sensitive recording papers (for example, as described in Japanese Patent Publications Nos. 4160/68, 7600/68 and 14039/70 and U.S. Pat. No. 2,939,090).

A printing process is also known which comprises forming a color image by supplying a coupler containing ink to a sheet having a developer layer coated thereon (as described in German Patent Application (OLS) No. 1,939,962).

Examples of developer include clays, phenol resins, metal salts of aromatic carboxylic acids, etc.

In general, the developer is uniformly applied to the total surface of a support. Accordingly, it is the general case that a process for desensitizing comprises applying a desensitizer containing composition to areas which are not to be recorded by means of a printing press, etc. As desensitizers, organic amines or quaternary salts thereof (see U.S. Pat. No. 2,777,780), tertiary amines prepared by chemically combining a monoalkylamine, aralkylamine or ethanolamine with ethylene oxide (see Japanese Patent Publication No. 35697/71), spiroacetal type diamines or reaction products prepared from a spiroacetal type diamine and an oxirane group containing compound (see German Patent Application (OLS) No. 2,343,800) and polyhydric alcohols such as polyethylene glycol or polypropylene glycol, etc., have been used as described hereinafter.

These desensitizers, however, all have an insufficient desensitizing effect, and, particularly, they are not effective on fluoran type couplers such as 3-diethylamino-7-dibenzylaminofluoran. When a coupler is brought into contact with a developer sheet as described above having a desensitizer layer, a developed image often appears with the passage of time, though the developer sheet seems to be perfectly desensitized initially.

Therefore, in the case of applying a densensitizer by printing it was necessary to apply it very thickly. Consequently, it was impossible to increase printing rates because the drying of the printed surface was retarded.

Further, in the case that a desensitizer coated surface was drawn or printed on using a colored ink, the printed or drawn image of the color ink was remarkably faded or blurred if the amount of desensitizer was increased.

In pressure-sensitive copying papers, if a coupler containing microcapsule layer is allowed to stand together with a developer sheet comprising a large amount of developer, the desensitizer swells the walls of the microcapsules to sometimes cause destruction of the microcapsules.

SUMMARY OF THE INVENTION

A first object of the present invention is to provide desensitizer compositions which exhibit a very high desensitizing effect on all couplers, particularly on fluoran type couplers.

A second object of the present invention is to provide desensitizer compositions which do not color with the passage of time.

A third object of the present invention is to provide densensitizer compositions which exhibit a sufficient effect even using a very small amount of desensitizer.

As a result of various research, the present inventors have found that the above objects can be attained by incorporating a compound(s) having an absorption peak in the wavelength range of from about 300 mμ to about 400 mμ, preferably from 350 mμ to 390 mμ, and a molecular absorption coefficient of above about 2,000, preferably above 5000 (hereinafter called additives) to a desensitizer composition. The general rule is that the higher the molecular absorption coefficient, the better the results.

DETAILED DESCRIPTION OF PREFERRED EMBODIMENT

Preferred additives are represented by the following Formula (I). Of course, the additives are not limited to these compounds.

Formula (I):

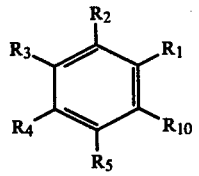

wherein $R_1$ is a monovalent aromatic group having 6 to 22 carbon atoms, preferably a group having one of the following structural formulae:

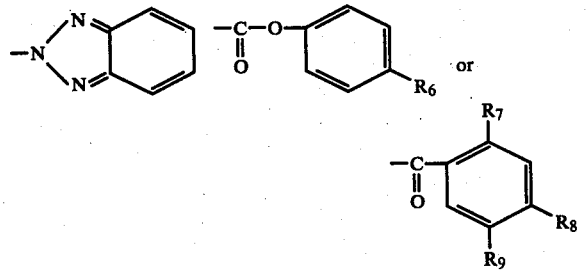

$R_2$ and $R_7$ are —H, —OH, —COOH, —OM or —COOM and $R_3$ to $R_6$ and $R_8$ to $R_{10}$ are —H, —OH, a halogen atom, an alkyl group having 1 to 22 carbon atoms, an alkoxy group having 1 to 22 carbon atoms, benzyloxy, $SO_3H$ or $SO_3M$; $R_3$ and $R_6$ are —H, or an alkyl group, for example, an alkyl group preferably having from 1 to 22 carbon atoms, preferably 1 to 12 carbon atoms; $R_4$ and $R_8$ are —H, —OH, a halogen atom such as chlorine or bromine, an alkoxy group, for example, an alkyl moiety having from 1 to 22 carbon atoms, preferably from 1 to 12 carbon atoms, or benzyloxy; $R_{10}$ and $R_5$ are —H, an alkyl group, for example, an alkyl group having from 1 to 22 carbon atoms, preferably from 1 to 12 carbon atoms, —$SO_3H$ or —$SO_3M$; and $R_9$ is —H, —$SO_3H$ or —$SO_3M$; at least one of $R_2$ or $R_4$ is —OH, preferably $R_2$; $R_3$ and $R_4$ or $R_4$ and $R_5$ may form a 5- or 6-membered ring composed of non-metallic atoms by linking to each other, such as cyclopentyl, cyclohexyl, phenyl, etc.; M is a metal which renders the additive water soluble, for example, an alkali metal such as sodiumm potassium or lithium.

Particularly preferred additives are phenols having a benzotriazoyl, a phenyloxycarbonyl or a phenylcarbonyl group in the ortho position.

Preferred materials within the above class are those of the formulae:

Formula (II)

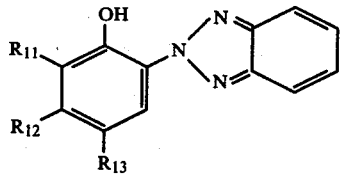

Formula (III)

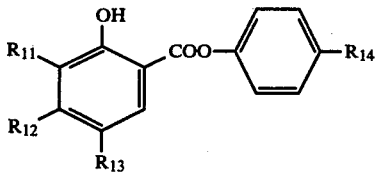

Formula (IV)

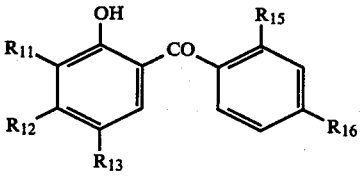

wherein $R_{11}$ to $R_{16}$ correspond to $R_3$ to $R_8$ respectively as defined for formula (I) above.

Of the above formulae II and III are preferred, with Formulae II being more preferred.

It can generally be said that phenols having an o-benzotriazolyl group are most preferred.

Examples of the compounds represented by the above described Formula (I) include the following compounds.

2-(2'-hydroxy-5'-methylphenyl)-benzotriazole
2-(2'-hydroxy-3',5'-di-tertiary-butylphenyl)-benzotriazole.
2-(2'-hydroxy-3'-tertiary-butyl-5'-methylphenyl)-benzotriazole
Phenyl salicylate
p-Octylphenyl salicylate
p-Tertiary-butylphenyl salicylate
2,4-Dihydroxy-benzophenone
2-Hydroxy-4-methoxy-benzophenone
2,2'-Dihydroxy-4-methoxy-benzophenone
2,2'-Dihydroxy-4,4'-dimethoxy-benzophenone
2,2',4,4'-Tetrahydroxy-benzophenone
2-Hydroxy-4-methoxy-5-sulfobenzophenone
2-Hydroxy-4-octadecyloxy-benzophenone
2-Hydroxy-4-chlorobenzophenone
2-Hydroxy-4-benzyloxybenzophenone These compounds can be used, if desired, singly or as a combination of two or more thereof.

Additives having a melting point of about 60° C. or more are advantageously used from the viewpoint of ease of handling.

The above described absorption peak is the value measured in an alcoholic solvent at a concentration of 0.001 weight % of the solution, e.g., in ethanol.

These additives are added to a desensitizer composition in an amount of from about 0.05% by weight (hereinafter, (often weight is omitted) to about 15%, preferably from 0.3% to 10%. All desensitizers exhibit an improved effect by the addition of one or more of the above described additives.

In its simpliest form, the present invention thus provides a desensitizer composition comprising one desensitizer plus one essential additive in accordance with the present invention as described above.

The amount of desensitizer present in the desensitizer composition is preferably from one to about 99.5% by weight, more preferably from 5 to 90% by weight based on the total amount of the desensitizer composition.

Various desensitizers with which the present invention finds application are described in detail in U.S. Pat. No. 2,777,780, Japanese Patent Publications Nos. 27255/69, 21448/70, 22651/71 and 2,9546/71, Japanese Patent Application (OPI) No. 32915/72, Japanese Patent Publications Nos. 38201/72 and 4050/73, Japanese Patent Application (OPI) No. 6805/73, Japanese Patent Publications Nos. 4484/74, 8288/74, 19647/74, 23008/74 and 23850/74, Japanese Patent Applications (OPI) Nos. 43708/74, 72009/74, 77709/74, 77710/74, 15513/74 and 83509/74 and Germany Patent Applications (OLS) Nos. 2,343,800, 2,359,079 and 2,361,856. Examples thereof include the following compounds: quaternary ammonium salts such as dodecyltrimethylammonium chloride or octadecylammonium chloride, etc.; reaction products prepared by reacting alkylene oxides, preferably where the alkylene group comprises 2 or 3 carbon atoms, with amines having a high molecular weight such as dodecylamine or dodecyldiamine, etc., substituted oxazolines such as 2,4,4-trimethyl-2-oxazoline, or diamine or polyamine derivatives having a cyclic structure in this molecule such as xylylenediamine or N-aminopropylpiperidine, etc.; (wherein any alkyl group or moiety in the following recited polyoxyethylene type compounds preferably has from 1 to 22 carbon atoms, most preferably from 1 to 12 carbon atoms and further wherein any polyoxyethylene chain is represented by the formula $\text{-}[CH_2\text{-}CH_2\text{-}O]_n\text{-}$ where n is from 2 to 100), polyoxyethylene alkylamines, polyoxyethylene alkyl ethers, polyoxyethylene esters, polyoxyethylene alkylphenyl ethers, polyethylene glycols, most preferably having a molecular weight of from about 200 to about 5,000, polypropylene glycols, most preferably having a molecular weight of from about 200 to about 8,000, polyoxypropylene alkylamines, polymers having a glutamic acid-γ-alkyl ester residue, spiroacetal type diamines, N-(aminoalkyl)-lactams and glycidyl ester addition products of amines, etc.

The desensitizer compositions of the present invention may be composed of only the desensitizer(s) and one or more of the above described additives or may include other additional ingredients.

It is preferred that the amount of the other additional ingredient(s) be 0 to about 80% by weight of the total amount of the desensitizer composition.

As the other additional ingredients included in the desensitizer compositions of the present invention, there are the materials used for conventional printing inks as described in "Printing Ink Technology" writen by E. A. Apps. LEONARD HILL (LONDON) (1961), Chapters 2–9. For example, the desensitizer compositions may include one or more natural or synthetic high molecular weight compounds, most preferably having a molecular weight of from about 10,000 to about 6,000,000, such as a ketone resin, polyamide resin, maleic acid resin, phenol resin, epoxy resin, alkyd resin, melamine resin, urea resin, nitrocellulose, ethyl cellulose, butyral resin, polyvinyl alcohol, gelatin, shellac, etc. (such are included in the desensitizer compositions in an amount of 0 to about 40%, preferably 5 to 25%), inorganic materials such as titanium dioxide, barium sulfate, calcium carbonate, talc, kaolin, bentonite, or organic bentonite, etc. (such are included in the desensitizer compositions in an amount of 0 to about 50%, preferably 0.3 to 40%), vegetable oils such as linseed oil, tung oil, soy bean oil or cotton seed oil, etc. (such are included in the desensitizer compositions in an amount of 0 to about 50%, preferably 0 to 20%), organic solvents such as methanol, ethanol, ethyl acetate, toluene, hexane, methylethyl ketone or methyl isobutyl ketone, etc. (such are included in the desensitizer compositions in an amount of 0 to about 60%, preferably 0 to 20%), waxes such as paraffin wax, microcrystalline wax or carnauba wax, etc. (such are included in the desensitizer compositions in an amount of 0 to about 10%, preferably 0 to 5%) and transfer preventing agents such as starch or dextrin, etc. (such are included in the desensitizer compositions in an amount of 0 to about 10%, preferably 0 to 5%). The desensitizer compositions of the present invention can easily be prepared by one skilled in the art by mixing or dissolving the above described ingredients or, if desired, using a three-roll mixer or a pebble mixer. The desensitizer compositions are supplied to the developer sheet by means of a printing press, by spraying with a sprayer or by drawing using crayons or eraser-like materials.

The desensitizer compositions of the present invention are applied to a developer layer in an amount of about 0.8 to about 10.0 g/m$^2$, preferably 1.5 to 6.0 g/m$^2$. While not particularly limitative, usually from about 10 to about 300 parts by weight of the desensitizer composition is applied based on 100 parts by weight of the developer composition.

Examples of the developers to which the desensitizer compositions of the present invention can be applied include clays (for example, acid clay, activated clay, attapulgite or kaolin, etc.), phenol resins and metal salts of aromatic carboxylic acids.

The phenol resins are those known in this field which release protons. Examples of the phenol resins include phenolaldehyde polymers (so-called novolak type resins) and phenolacetylene polymers as are disclosed in U.S. Pat. Nos. 3,455,721, 3,516,845, and 3,649,357.

For example, there are p-phenylphenol-formaldehyde polymers, p-fluorophenol-formaldehyde polymers, p-chlorophenol-formaldehyde polymers, p-bromophenol-formaldehyde polymers, p-iodophenol-formaldehyde polymers, p-nitrophenol-formaldehyde polymers, p-carboxyphenol-formaldehyde polymers, o-carboxyphenol-formaldehyde polymers, p-carboalkoxyphenol-formaldehyde polymers, p-aroylphenol-formaldehyde polymers, p-alkoxyphenol-formaldehyde polymers, where preferred alkoxy groups have from 1 to 12 carbon atoms, and copolymers of formaldehyde and p-alkyl($C_1$–$C_{12}$) phenols (for example, p-methyl phenol, p-ethylphenol, p-n-propylphenol, p-isopropylphenol, p-n-amylphenol, p-isoamylphenol, p-cyclohexylphenol, p-1,1-dimethyl-n-propylphenol, p-n-hexylphenol, p-isohexylphenol, p-1,1-dimethyl-n-butylphenol, p-1,2-dimethyl-n-butylphenol, p-n-heptylphenol, p-isoheptylphenol, p-5,5-dimethyl-n-amylphenol, p-1,1-dimethyl-n-amylphenol, p-n-octylphenol, p-1,1,3,3-tetramethylbutylphenol, p-isooctylphenol, p-n-nonylphenol, p-isononylphenol, p-1,1,3,3-tetramethylamylphenol, p-n-decylphenol, p-isodecylphenol, p-n-undecylphenol, p-isoundecylphenol or p-n-dodecylphenol), an isomer of the above described p-alkylphenols (the alkyl group has 1–12 carbon atoms) or a mixture of two or more of the above described p-alkylphenols and isomers thereof. Most preferred of the above materials are those having a degree of condensation reaction of from about 2 to about 7. The presence of meta-substituents is not important because para-substituted phenols having one or more meta-substituents have the same behavior as the above described para-substituted phenols.

The metal salts of aromatic carboxylic acids include metal salts such as copper, lead, magnesium, calcium, zinc, aluminium, tin or nickel, etc., of aromatic carboxylic acids as are disclosed in U.S. application Ser. No. 192,594 filed Oct. 26, 1971.

Examples of the aromatic carboxylic acids include benzoic acid, chlorobenzoic acid (o-, m- or p-), nitrobenzoic acid (o-, m- or p-), toluic acid (o, m- or p-), 4-methyl-3-nitrobenzoic acid, 2-chloro-4-nitrobenzoic acid, 2,3-dichlorobenzoic acid, 2,4-dichlorobenzoic acid, p-isopropylbenzoic acid, 2,5-dinitrobenzoic acid, p-tert-butylbenzoic acid, N-phenylanthranilic acid, 4-methyl-3-nitrobenzoic acid, salicyclic acid, m-hydroxybenzoic acid, p-hydroxybenzoic acid, 3,5-dinitrosalicylic acid, 5-tert-butylsalicylic acid, 3-phenylsulicylic acid, 3-methyl-5-tert-butylsalicylic acid, 3,5-di-tert-butylsalicylic acid, 3,5-di-tert-amylsalicylic acid, 3-cyclohexylsalicylic acid, 5-cyclohexylsalicylic acid, 3-methyl-5-isoamylsalicylic acid, 5-isoamylsalicylic acid, 3,5-di-sec-butylsalicylic acid, 5-nonylsalicylic acid, 2-hydroxy-3-methylbenzoic acid, 2-hydroxy-5-tert-butylbenzoic acid, 2,4-cresotic acid, 5,5-methylenedisalicylic acid, acetaminobenzoic acid (o-, m- or p-), 2,4-dihydroxybenzoic acid, 2,5-dihydroxybenzoic acid, anacardic acid, 1-naphthoic acid, 2-naphthoic acid, 1-hydroxy-2-naphthoic acid, 2-hydroxy-3-naphthoic acid, 2-hydroxy-1-naphthoic acid, thiosalicylic acid and 2-carboxybenzaldehyde, etc.

The couplers which react with the developers to which the desensitizer compositions of the present invention can be applied are conventional and are not limited. Many of such couplers are disclosed in U.S. Pat. No. 3,669,711. Specific examples of such couplers include triarylmethane compounds such as 3,3-bis-(p-dimethylaminophenyl)-6-dimethylaminophthalide, namely, Crystal Violet, 3,3-bis-(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide, or 3-p-dimethylaminophenyl-3-(1-methylpyrrol-2-yl)-6-dimethylaminophthalide, etc.; diphenylmethane compounds such as 4,4'-bis-dimethylaminobenzohydrin benzyl ether, N-halophenyl-leuco-Auramine or N-2,4,5-trichlorophenyl leuco Auramine, etc.; xanthene compounds such as Rhodamine B anilinolactam, Rhodamine B p-nitroanilinolactam, Rhodamine B p-chloroanilinolactam, 3-dimethylamino-7-methoxyfluoran, 3-diethylamino-7-methoxy-fluoran, 3-diethylamino-6-methoxyfluoran, 3-diethylamino-7-chlorofluoran, 3-diethylamino-7-chloro-6-methylfluoran, 3-diethylamino-6,8-dimethylfluoran, 3-diethylamino-7-acetylmethylaminofluoran, 3-diethylamino-7-methylaminofluoran, 3,7-diethylaminofluoran, 3-diethylamino-7-dibenzylaminofluoran, 3-diethylamino-7-methylbenzylaminofluoran, 3-diethylamino-7-phenylamino-3-methylfluoran, 3-diethylamino-7-chloroethylmethylamino-fluoran or 3-diethylamino-7-dichloroethylamino-fluoran, etc.; thiazine compounds such as benzoyl leuco Methylene Blue or p-nitrobenzyl leuco Methylene Blue, etc.; spiro compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-(3-methoxybenzo)-spiropyran or 3-propyl-spiro-dibenzopyran, etc. or mixtures of these compounds.

The coupler is applied to the support after being encapsulated by dissolution in a solvent or dispersion in a binder solution in a conventional manner.

As the solvent, natural or synthetic oils can be used alone or as a mixture thereof. Examples of the solvents include cotton seed oil, kerosene, paraffin, naphthene oil, alkylated biphenyls, alkylated terphenyls, chlorinated paraffin and alkylated naphthalenes, etc. As useful processes for producing microcapsules, there are processes utilizing coacervation of a hydrophilic colloidal sol as described in U.S. Pat. Nos. 2,800,457 and 2,800,458 and an interfacial polymerization process as described in British Patents 867,797, 950,443, 989,264 and 1,091,076, etc. The capsules can be formed in other fashions, of course.

The effect of the desensitizer compositions of the present invention was confirmed by using the following developer sheets and coupler sheets. Unless otherwise indicated, in the following all processings are at room temperature and all parts are by weight.

DEVELOPER SHEET A 200 parts of activated clay were dispersed in 800 parts of water. The pH of the dispersion was adjusted to 10.0 by adding a 20% aqueous solution of sodium hydroxide. To this dispersion, 40 parts (solids content) of a styrene-butadiene copolymer (60 mol % styrene component; molecular weight of about 25,000) latex and 60 parts of a 10% aqueous solution of starch were added to prepare a coating solution of the present invention. This coating solution was applied to a sheet of paper of 50 g/m$^2$ by a coating rod so as to provide a 6 g/m$^2$ solids content and dried.

DEVELOPER SHEET B 5 parts of acid clay and 1 part of aluminum oxide were added to 20 parts of water. A 20% aqueous solution of sodium hydroxide was added to the resultant dispersion with stirring to adjust the pH to 10.5. 6 parts of a 10% aqueous solution of gelatin were added thereto and then a solution prepared by dissolving 0.56 parts of zinc chloride in 8 parts of water was slowly added thereto.

Then, a solution prepared by dissolving 2 parts of 3,5-di-tert-butylsalicylic acid in 20 parts of a 15% aqueous solution of sodium hydroxide was slowly added thereto to cause reaction. To the resultant dispersion, 3 parts (solids content) of a styrene-methyl methacrylate copolymer (50 mol% styrene component; molecular weight of about 35,000) latex were added to prepare a coating solution. This coating solution was applied to a sheet of paper of 50 g/m$^2$ by a coating rod so as to provide a 4 g/m$^2$ solids content and dried.

DEVELOPER SHEET C 170 parts of p-phenylphenol were reacted with 70 parts of a 37% aqueous solution of formaldehyde in the presence of 10 parts of hydrochloric acid (37%) and 50 parts of water by refluxing for 10 hours. After being cooled, the resultant phenol resin was taken out as a powder.

40 parts of this phenol resin and 6 parts of a naphthalene sulfonic acid-formaldehyde condensate (average molecular weight: 600; molar ratio 1:1) were ball milled for one day with 54 parts of water. 100 parts of the resultant phenol resin dispersion, 160 parts of kaolin and 40 parts (solids content) of a methyl methacrylate-butadiene copolymer (50 mol% of the butadiene component; molecular weight of about 40,000) latex as a binder were added to 500 parts of water and the mixture stirred to produce a coating solution of the present invention. This coating solution was applied to a sheet of paper of 50 g/m$^2$ by a coating rod so as to provide a 5 g/m$^2$ solids content and dried.

PREPARATION OF COUPLER SHEET A 10 parts of acid treated gelatin having an isoelectric pont of 80 and 10 parts of gum arabic were dissolved in 60 parts of water at 40° C. After adding 0.2 parts of sodium benzenesulfonate as an emulsifier to this solution, 50 parts of a coupler containing oil were added and the system stirred to emulsify the same.

The coupler containing oil was produced by dissolving 2.5% by weight of Crystal Violet lactone and 2.0% by weight of benzoyl leuco Methylene Blue in an oily mixture of 4 parts of diisopropylbiphenyl and 1 part of kerosene.

When the average particle size of emulsified drops became 8 microns, 100 parts of water at 40° C. were added to stop the progress of emulsification.

Further, 210 parts of water at 30° C. were added thereto while stirring was continued. The pH of the system was adjusted to 4.4 by adding 20% hydrochloric acid. The solution was cooled to 8° C. while stirring was continued and 1.5 parts of 20% glutaraldehyde were then added thereto.

Then, 30 parts of a 10% solution of carboxymethyl starch were added thereto. After adjusting the pH to 8.5 by dropwise adding 25% aqueous sodium hydroxide, the mixture was heated to 30° C. to obtain microcapsules having hardened walls.

10 parts of cellulose flock were then dispersed in the resultant liquid and the resultant mixture applied to a sheet of paper of 40 g/m$^2$ so as to provide a 6 g/m$^2$ solids content to produce Coupler Sheet A.

PREPARATION OF COUPLER SHEET B

1% by weight of Crystal Violet lactone, 4% by weight of 3-diethylamino-7-diethylamino-fluoran, 4% by weight of 3-diethylamino-7-phenylamino-fluoran, 3% by weight of 3-diethylamino-7,8-benzofluoran, 0.5% by weight of 3,6-bismethoxy-fluoran and 2% by weight of benzoyl leuco Methylene Blue were dissolved in an oil composed of 1 part of diisopropylnaphthalene, 1 part of diisopropylbiphenyl and 2 parts of 1-(dimethylphenyl)-1-phenylethane to produce a coupler containing oil. Coupler Sheet B was produced in the same manner as in Coupler Sheet A using 50 parts of the resultant coupler containing oil.

PREPARATION OF DESENSITIZING INK 15 parts of a rosin modified acid resin (softening point: 120° C., acid value: 150) were added to 50 parts of a desensitizer as shown in Table 1 and dissolved therein by heating at 150° C. for 1 hour. After adding 35 parts of titanium dioxide the mixture was kneaded in a 3-roll mixer to produce a desensitizing ink base. The additives shown in Table 1 were added to this desensitizing ink base to prepare desensitizing inks.

METHOD OF EXAMINATION

Each desentizing ink was applied by printing to each developer sheet in an amount of 4.5 g/m$^2$.

A densensitized portion of the resultant sample was subjected to contact with a coupler sheet and color development was carried out by applying a load pressure of 600 kg/cm$^2$. After being allowed to stand for 3 hours in a normally lit room, the reflection visual density (Vis. D) was measured using a densitometer to evaluate the densensitizing effect. The results are shown in Table 3.

Comparison examples are shown in Table 2.

Table 1

| Example | Desensitizer |
|---|---|
| Example 1 | $C_{18}H_{37}-N(C_2H_4O)_8H)(C_2H_4O)_8H$ |
| Example 2 | $H(OC_3H_6)_p(OC_2H_4)_a$ $(C_2H_4O)_r(C_3H_6O)_cH$ $(CH_2)_2$ $H(OC_3H_6)_q(OC_2H_4)_b$ $(C_2H_4O)_s(C_3H_6O)_dH$ $(p + q + r + s = 50, a + b + c + d = 10)$ |
| Example 3 | Polyethylene glycol (average molecular weight: 400) |
| Example 4 | 3,9-Bis-(3-aminomethyl)-2,4,8,10-tetraoxaspiro(5,5) undecane |
| Example 5 | $HO(CH_2CH_2O)_m(CHCH_3CH_2O)_p(CH_2CH_2O)_nH$ $(m + n = 5, p = 30)$ |
| Example 6 | $CH_3-Si(CH_3)_2-O-Si(CH_3)_2(OCH_2CH_2)_{10}-OH$ |

Table 1-continued

| Additive | Amount (wt %) | Wavelength of the absorption peak (λmax) at 300 mμ to 400 mμ of the additive in a solution (0.001 weight % of the additive based on the solution weight) in ethanol and the molecular absorption coefficient (ε) therein | |
|---|---|---|---|
| 2-(2'-Hydroxy-5'-methyl-phenyl)-benzotriazole | 2 | λmax | 304 mμ |
| | | ε | 15,000 |
| 2-(2'-Hydroxy-3',5'-di-tert-butylphenyl)-benzotriazole | 2 | λmax | 340 m μ |
| | | ε | 14,000 |
| p-tert-Butylphenyl-salicylate | 3 | λmax | 310 mμ |
| | | ε | 5,500 |
| 2-Hydroxy-4-methoxy-benzophenone | 2 | λmax | 323 mμ |
| | | ε | 14,800 |
| 2,4-Dihydroxybenzo-phenone | 2 | λmax | 325 mμ |
| | | ε | 9,800 |
| 2-Hydroxy-4-benzyloxy-benzophenone | 3 | λmax | 330 mμ |
| | | ε | 10,300 |

Table 2

| | Content |
|---|---|
| Comparision 1 | The same as Example 1 except that 2-(2'-hydroxy-5-methylphenyl)-benzotriazole was not added. |
| Comparison 2 | The same as Example 2 except that 2-(2'-hydroxy-3',5'-di-tert-butylphenyl)-benzotriazole was not added. |
| Comparison 3 | The same as Example 3 except that p-tert-butyl phenylsalicylate was not added. |
| Comparison 4 | The same as Example 4 except that 2-hydroxy-4-methoxybenzophenone was not added. |
| Comparison 5 | The same as Example 5 except that 2,4-dihydroxy-benzophenone was not added. |
| Comparison 6 | The same as Example 6 except that 2-hydroxy-4-benzyloxybenzophenone was not added. |
| Comparison 7 | The same as Example 1 except that (cis-) stilbene (λmax: 283 mμ, ε: 12,300, 0.001 wt. % solution in ethanol) was used instead of 2-(2'-hydroxy-5-methylphenyl)benzotriazole. |
| Comparison 8 | The same as Example 1 except that 2,6-dimethyl-naphthalene (λmax: 324 mμ, ε: 1,380, 0.001 wt. % solution, in iso-octane) was used instead of 2-(2'-hydroxy-5-methylphenyl)-benzotriazole. |

Table 3

| | Desensitizing Effect (Vis. D) | | | |
|---|---|---|---|---|
| | Coupler Sheet A | | | Coupler Sheet B |
| | Developer Sheet A | Developer Sheet B | Developer Sheet C | Developer Sheet A |
| Example 1 | 0.05 | 0.05 | 0.05 | 0.07 |
| Example 2 | 0.05 | 0.05 | 0.05 | 0.07 |
| Example 3 | 0.07 | 0.06 | 0.07 | 0.08 |
| Example 4 | 0.06 | 0.05 | 0.06 | 0.08 |
| Example 5 | 0.06 | 0.06 | 0.06 | 0.08 |
| Example 6 | 0.06 | 0.05 | 0.05 | 0.07 |
| Comparison 1 | 0.09 | 0.09 | 0.10 | 0.16 |
| Comparison 2 | 0.10 | 0.09 | 0.10 | 0.17 |
| Comparison 3 | 0.12 | 0.09 | 0.11 | 0.19 |
| Comparison 4 | 0.09 | 0.09 | 0.10 | 0.16 |
| Comparison 5 | 0.11 | 0.10 | 0.10 | 0.18 |
| Comparison 6 | 0.11 | 0.10 | 0.09 | 0.17 |
| Comparison 7 | 0.09 | 0.07 | 0.08 | 0.13 |
| Comparison 8 | 0.08 | 0.08 | 0.07 | 0.10 |

It is clear from Table 3 that the desensitizing compositions of the present invention are highly effective. In Table 3, the numerical values show the desensitizing effect, wherein 0.08 or less means that the desensitization was carried out nearly perferctly.

In the case that the additives of the present invention are not present, a color image appears when the desensitized surface is allowed to stand for 3 weeks under normal room illumination. However, it becomes possible to carry out perfect desensitization by adding the additives of the present invention. It can be understood from the results of Table 3 that the desensitization is carried out perfectly even with the coupler sheet containing a fluoran type coupler which was difficult to desensitize if the desensitizer compositions of the present invention are not used. It is further possible to enhance the function of known prior art desensitizers by adding the additives of the present invention, and, consequently, it becomes possible to obtain a sufficient effect using even in a small amount thereof.

While the invention has been described in detail and with reference to specific embodiments thereof, it will be apparent to one skilled in the art that various changes and modifications can be made therein without departing from the spirit and scope thereof.

What is claimed is:

1. Desensitizer compositions which reduce or extinguish the capability of developers to color colorless compounds which comprises one or more desensitizers in combination with one or more compounds having an absorption peak in the wavelength region of from about 300 mμ to about 400 mμ and a molecular absorption coefficient of above about 2,000 wherein said one or more compounds is a phenol compound having a benzotriazolyl, phenyloxycarbonyl or phenylcarbonyl group at a position ortho to the phenolic hydroxy group.

2. Compositions as set forth in claim 1 which comprise at least about 0.05% by weight of said one or more compounds and from about 1 to 99.5 weight % of said one or more desensitizers, based on the total amount of the desensitizer composition.

3. Compositions as set forth in claim 1, wherein said developer is an electron accepting or proton releasing solid acid.

4. The composition of claim 1, wherein said one or more desensitizers is a member selected from the group consisting of quaternary ammonium salts, reaction products prepared by reacting alkylene oxides with high molecular weight amines, substituted oxazolines, xylene diamine or N-aminopropylpirperidine, polyoxyethylene alkyl ethers, polyoxyethylene esters, polyoxyethylene alkylphenyl ethers, polyethylene glycols, polypropylene glycols, polyoxypropylene alkylamines, polymers having a glutamic acid-alkyl ester residue, spiroacetal type diamines, N-(amino-alkyl)lactams and glycidyl ester addition products of amines.

5. The desensitizing composition of claim 1, wherein said one or more compounds is a phenol compound having a benzotriazolyl group at a position ortho to the phenolic hydroxy group.

6. The desensitizer compositions of claim 1, wherein said one or more compounds is a phenol compound having a phenyloxycarbonyl group at a position ortho to the phenolic hydroxy group.

7. The desensitizer compositions of claim 1, wherein said one or more compounds is a phenol compound having a phenylcarbonyl group at a position ortho to the phenolic hydroxy group.

8. Compositions as set forth in claim 1, wherein said one or more compounds are represented by formula (I):

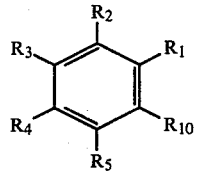

(I)

wherein $R_1$ is

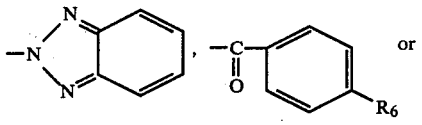

or

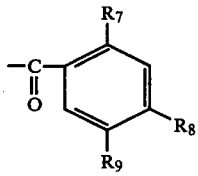

$R_2$ and $R_7$ are —H, —OH, —COOH, —OM or —COOM; $R_3$ to $R_6$ and $R_8$ to $R_{10}$ are selected from the group consisting of —H, —OH, a halogen atom, an alkyl group having 1 to 22 carbon atoms, an alkoxy group having 1 to 22 carbon atoms, benzyloxy, $SO_3H$ and $SO_3M$ and $R_3$ and $R_4$ or $R_4$ and $R_5$ may form a 5 or 6 membered ring composed of non-metallic atoms by linking to each other, and M is a metal which renders the compound water soluble, where at least one of $R_2$ or $R_4$ is —OH, and when $R_4$ is —OH, $R_{10}$ is —OH.

9. The desensitizer composition of claim 3, wherein $R_1$ is

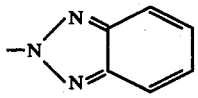

10. The desensitizer composition of claim 8, wherein $R_1$ is

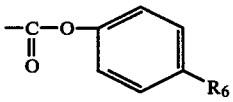

11. The desensitizer composition of claim 8, wherein $R_1$ is

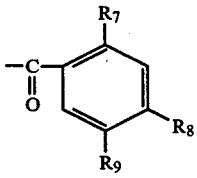

12. The composition as set forth in claim 8 where $R_2$ and $R_7$ are —H, —OH, —COOH, —OM or —COOM; $R_3$ and $R_6$ are —H or an alkyl group having from 1 to 22 carbon atoms; $R_4$ and $R_8$ are —H, —OH, a halogen atom, an alkoxy group having from 1 to 22 carbon atoms or benzyloxy; $R_{10}$ and $R_5$ are —H, an alkyl group having from 1 to 22 carbon atoms, $—SO_3H$ or $—SO_3M$ and $R_{10}$ additionally is —OH; $R_9$ is —H, $—SO_3H$ or $—SO_3M$; and $R_3$ and $R_4$ or $R_4$ and $R_5$ may from a 5 or 6 membered ring composed of non-metallic atoms by linking to each other, and M is a metal which renders the compound water soluble, where at least one of $R_2$ or $R_4$ is —OH and when $R_4$ only is —OH, $R_{10}$ is —OH.

13. Compositions as set forth in claim 12 wherein said alkyl group has from 1 to 12 carbon atoms, said alkoxy group has from 1 to 12 carbon atoms and said halogen atom is chlorine or bromine.

14. Compositions as set forth in claim 1, wherein said one or more compounds are represented by the general formulae:

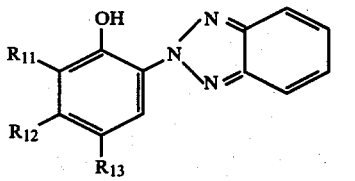

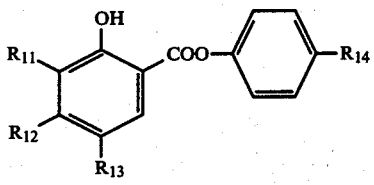

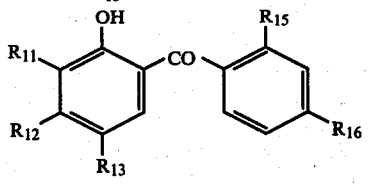

wherein $R_{11}$ and $R_{14}$ are —H or an alkyl group having from 1 to 22 carbon atoms, $R_{12}$ and $R_{16}$ are —H, —OH, a halogen atom, an alkoxy group having from 1 to 22 carbon atoms or benzyloxy, and $R_{13}$ is —H, an alkyl group having 1 to 22 carbon atoms, $—SO_3H$ or $—SO_3M$; $R_{15}$ is —H, —OH, —COOH, —OM or —COOM: $R_{11}$ and $R_{12}$ or $R_{12}$ and $R_{13}$ may form a 5 or 6 membered ring composed of non-metallic atoms by linking to each other.

15. The desensitizer composition of claim 14 wherein said compound is represented by the formula

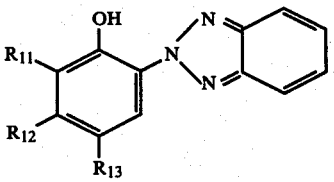

atoms; $R_{12}$ is —H, —OH, a halogen atom, an alkoxy group having 1 to 22 carbon atoms or benzyloxy; and $R_{13}$ is —H, an alkyl group having 1 to 22 carbon atoms, $—SO_3H$ or $—SO_3M$ and $R_{11}$ and $R_{12}$ or $R_{12}$ and $R_{13}$ may form a five or six membered ring composed of non-metallic atoms by linking to each other.

16. The desensitizer composition of claim 14 wherein said compound is represented by the formula

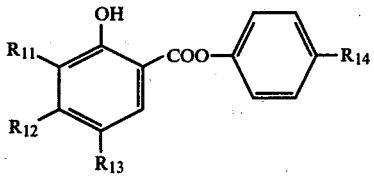

wherein $R_{11}$ and $R_{14}$ are —H or an alkyl group having from 1 to 22 carbon atoms; $R_{12}$ is —H, —OH, a halogen atom, an alkoxy group having 1 to 22 carbon atoms or benzyloxy; and $R_{13}$ is —H, an alkyl group having 1 to 22 carbon atoms, $—SO_3H$ or $—SO_3M$ and $R_{11}$ and $R_{12}$ or $R_{12}$ and $R_{13}$ may form a five or six membered ring composed of non-metallic atoms by linking to each other.

17. The desensitizer composition of claim 14 wherein said compound is represented by the formula

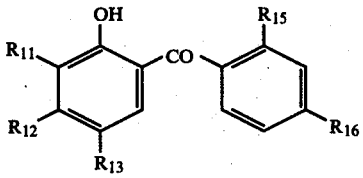

wherein $R_{11}$ is —H or an alkyl group having from 1 to 22 carbon atoms; $R_{12}$ and $R_{16}$ are —H, —OH, a halogen atom, an alkoxy group, having 1 to 22 carbon atoms or benzyloxy; and $R_{13}$ is —H, an alkyl group having 1 to 22 carbon atoms, $—SO_3H$ or $—SO_3M$; $R_{15}$ is —H, —OH, —COH, —OM or —COM; $R_{11}$ and $R_{12}$ or $R_{12}$ and $R_{13}$ may form a five or six membered ring composed of non-metallic atoms by linking to each other.

18. A process for desensitizing a developer layer comprising an electron accepting or proton releasing solid acid which comprises applying to all or part of the developer layer a desensitizer composition which reduces or extinguishes the function of the developer for coloring colorless compounds, which desensitizer composition consists essentially of 1 to 99.5 weight% based on the total weight of said composition of one or more desensitizers and at least 0.5 weight% of one or more compounds having an absorption peak in the wavelength region of from about 300 mμ to about 400 mμ and a molecular absorption coefficient of above about 2,000, said compounds being represented by the formula (I):

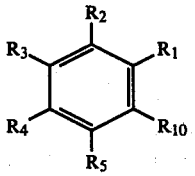

(I)

wherein $R_1$ is

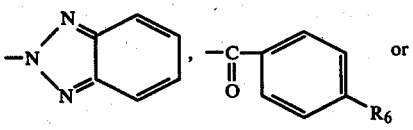

or

-continued

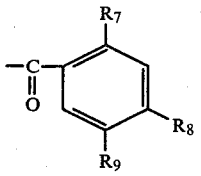

$R_2$ and $R_7$ are —H, —OH, —COOH, —OM or —COOM; $R_3$ to $R_6$ and $R_8$ to $R_{10}$ are selected from the group consisting of —H, —OH, a halogen atom, an alkyl group having 1 to 22 carbon atoms, an alkoxy group having 1 to 22 carbon atoms, benzyloxy, $SO_3H$ and $SO_3M$; and $R_3$ and $R_4$ or $R_4$ and $R_5$ may form a 5 or 6 membered ring composed of non-metallic atoms by linking to each other, and M is a metal which renders the compound water soluble, where at least one of $R_2$ or $R_4$ is —OH, and when $R_4$ only is —OH, $R_{10}$ is —OH.

19. The process of claim 18, wherein said developer is an electron accepting or proton releasing solid acid.

20. The process of claim 18 wherein said desensitizer composition is applied to only a part of said developer layer.

21. The process of claim 18 wherein $R_1$ is

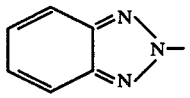

22. The process of claim 18 wherein $R_1$ is

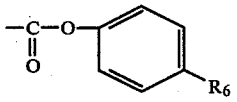

23. The process of claim 18 wherein $R_1$ is

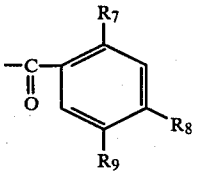

24. The process of claim 18, wherein said one or more desensitizers is a member selected from the group consisting of quaternary ammonium salts, reaction products prepared by reacting alkylene oxides with high molecular weight amines, substituted oxazolines, xylene diamine or N-aminopropylpirperidine, polyoxyethylene alkyl ethers, polyoxyethylene esters, polyoxyethylene alkylphenyl ethers, polyethylene glycols, polypropylene glycols, polyoxypropylene alkylamines, polymers having a glutamic acid-alkyl ester residue, spiroacetal type diamines, N-(amino-alkyl)lactams and glycidyl ester addition products of amines.

25. The process of claim 18 wherein $R_3$ and $R_6$ are —H or an alkyl group having from 1 to 22 carbon atoms; $R_4$ and $R_8$ are —H, —OH, a halogen atom, an alkoxy group having from 1 to 22 carbon atoms or benzyloxy; $R_{10}$ and $R_5$ are —H, an alkyl group having from 1 to 22 carbon atoms, —$SO_3H$ or —$SO_3M$ and R additionally is —OH; $R_9$ is —H, —$SO_3H$ or —$SO_3M$; and $R_3$ and $R_4$ or $R_4$ and $R_5$ may form a 5 or 6 membered ring composed of non-metallic atoms by linking to each other, and M is a metal which renders the compound water soluble; where at least one of $R_2$ or $R_4$ is —OH and when $R_4$ only is —OH, $R_{10}$ is —OH.

26. The process of claim 25, wherein said alkyl group has from 1 to 12 carbon atoms, said alkoxy group has from 1 to 12 carbon atoms and said halogen atoms is chlorine or bromine.

27. The process of claim 18 wherein said one or more compounds are represented by the formulae:

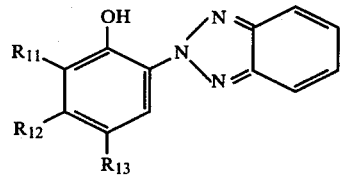

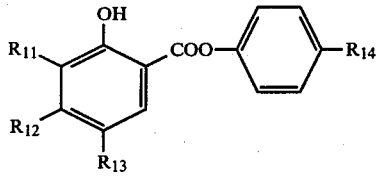

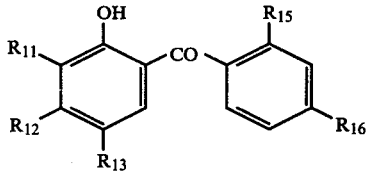

wherein $R_{11}$ and $R_{14}$ are —H or an alkyl group having from 1 to 22 carbon atoms; $R_{12}$ and $R_{16}$ are —H, —OH, a halogen atom, an alkoxy group having from 1 to 22 carbon atoms or benzyloxy; and $R_{13}$ is —H, an alkyl group having 1 to 22 carbon atoms, —$SO_3H$ or —$SO_3M$; $R_{15}$ is —H, —OH, —COOH, —OM or —COOM; $R_{11}$ and $R_{12}$ or $R_{12}$ and $R_{13}$ may form a 5 or 6 membered ring composed of non-metallic atoms by linking to each other.

28. The process of claim 11 wherein said compound is represented by the formula

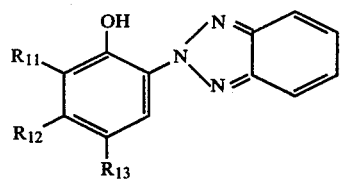

wherein $R_{11}$ is —H or an alkyl group having from 1 to 22 carbon atoms; $R_{12}$ is —H, —OH, a halogen atom, an alkoxy group having 1 to 22 carbon atoms or benzyloxy; and $R_{13}$ is —H, an alkyl group having 1 to 22 carbon atoms, —$SO_3H$ or —$SO_3M$ and $R_{11}$ and $R_{12}$ or $R_{12}$ and $R_{13}$ may form a five or six membered ring composed of non-metallic atoms by linking to each other.

29. The process of claim 27, wherein said compound is represented by

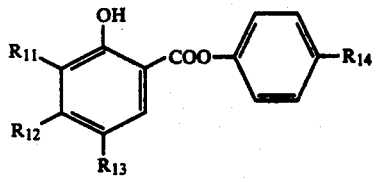

wherein $R_{11}$ and $R_{14}$ are —H or an alkyl group having from 1 to 22 carbon atoms; $R_{12}$ is —H, —OH, a halogen atom, an alkoxy group having 1 to 22 carbon atoms or benzyloxy; and $R_{13}$ is —H, an alkyl group having 1 to 22 carbon atoms, —$SO_3H$ or —$SO_3M$ and $R_{11}$ and $R_{12}$ or $R_{12}$ and $R_{13}$ may form a five or six membered ring composed of non-metallic atoms by linking to each other.

30. The process of claim 27, wherein said compound is represented by the formula

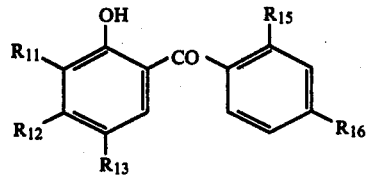

wherein $R_{11}$ is —H or an alkyl group having from 1 to 22 carbon atoms; $R_{12}$ and $R_{16}$ are —H, —OH, a halogen atom, an alkoxy group having 1 to 22 carbon atoms or benzyloxy; and $R_{13}$ is —H, an alkyl group having 1 to 22 carbon atoms, —$SO_3H$ or —$SO_3M$; $R_{15}$ is —H, —OH, —COH, —OM or —COM; $R_{11}$ and $R_{12}$ or $R_{12}$ and $R_{13}$ may form a five or six membered ring composed of non-metallic atoms by linking to each other.

* * * * *